US007322303B2

(12) United States Patent
Tajima

(10) Patent No.: US 7,322,303 B2
(45) Date of Patent: Jan. 29, 2008

(54) NEEDLE BAR DRIVE APPARATUS FOR SEWING MACHINE

(75) Inventor: Ikuo Tajima, Kasugai (JP)

(73) Assignee: Tokai Kogyo Mishin Kabushiki Kaisha (JP)

( * ) Notice: Subject to any disclaimer, the term of this patent is extended or adjusted under 35 U.S.C. 154(b) by 0 days.

(21) Appl. No.: 10/577,565

(22) PCT Filed: Oct. 27, 2004

(86) PCT No.: PCT/JP2004/015915

§ 371 (c)(1),
(2), (4) Date: Apr. 27, 2006

(87) PCT Pub. No.: WO2005/040479

PCT Pub. Date: May 6, 2005

(65) Prior Publication Data

US 2007/0107470 A1 May 17, 2007

(30) Foreign Application Priority Data

Oct. 27, 2003 (JP) ..... 2003-366097

(51) Int. Cl.
*D05B 69/00* (2006.01)

(52) U.S. Cl. ..... 112/221

(58) Field of Classification Search ..... 112/221, 112/220

See application file for complete search history.

(56) References Cited

U.S. PATENT DOCUMENTS 3,492,959 A * 2/1970 Berg et al. ..... 112/220
3,857,345 A * 12/1974 Higgins ..... 112/80.42
4,616,585 A 10/1986 Marcandalli
5,706,746 A * 1/1998 Zeller ..... 112/221
5,797,337 A * 8/1998 Papajewski et al. ..... 112/221

FOREIGN PATENT DOCUMENTS

JP 63-57078 B2 11/1988
JP 3-37960 B2 6/1991
JP 4-347192 A 12/1992
JP 5-208087 A 8/1993

OTHER PUBLICATIONS

Relevant portion of International Search Report of corresponding PCT Application PCT/JP2004/015915.

* cited by examiner

*Primary Examiner*—Danny Worrell
(74) *Attorney, Agent, or Firm*—Rossi, Kimms & McDowell LLP

(57) ABSTRACT

A needle bar drive apparatus for a sewing machine includes a dedicated drive source (16) for driving a needle bar (3) of the sewing machine to move up and down. When a sewing operation is to be performed, a control section (160) controls the drive source to cause the needle bar to move up and down within a predetermined stroke range, but, when no sewing operation is to be performed, the control section controls the drive source to cause the needle bar to retreat to a predetermined evacuation position set above a top dead center in the predetermined stroke range. The control section is also capable of varying a timewise pattern of the upward and downward movement of the needle bar within the predetermined stroke range. Thus, it is possible to secure an increased space between the lower end of the needle bar and the upper surface of a sewing machine table (6) during a non-sewing period while limiting the stroke of the needle bar to a necessary minimum during a sewing period. Also, timing for driving the needle bar can be varied freely.

5 Claims, 9 Drawing Sheets

NEEDLE BAR DRIVE APPARATUS FOR SEWING MACHINE

This is a U.S. National Phase Application of PCT International Application PCT/JP2004/015915 filed on Oct. 27, 2004.

TECHNICAL FIELD

The present invention relates generally to needle bar drive apparatus for sewing machines, and more particularly to a needle bar drive apparatus for a sewing machine where needle bar driving timing can be varied with ease and a needle bar stroke during a sewing operation (i.e., sewing stroke) can be reduced to a necessary minimum, and where, during stoppage of the sewing operation, the needle bar can be evacuated above a top dead point or center of the sewing stroke.

BACKGROUND ART

One example of the conventionally-known needle bar drive apparatus for sewing machines is disclosed in Japanese Patent Publication No. HEI-3-37960, which particularly shows an embroidery sewing machine equipped with needle bar driving mechanisms driven by linear motors. According to the disclosure, a separate linear motor for driving a needle bar is provided for each machine head of the multi-head embroidery sewing machine, and a detection device is provided for detecting a rotational angle of a hook shaft that rotates a rotary hook provided per machine head. Because operation of each of the linear motors is controlled in synchronism with the rotational angle of the hook shaft detected by the detection device, the disclosed technique can eliminate a need for a complicated power transmission mechanism, such as a cam mechanism, for driving the needle bar, and it can simplify the construction of the needle bar driving mechanism. Further, by appropriately controlling the behavior or condition of the linear motor, the disclosed technique can freely set the needle bar driving timing in response to a change in the sewing condition.

According to the disclosure in the No. HEI-3-37960 publication, a stroke over which the needle bar is driven to move up and down during a sewing operation has a fixed length, and the top dead center of the stroke is set at a predetermined position greatly spaced apart from the upper surface of a machine table. This is because there has been a need to secure a sufficient interval or space between the lower end of the needle bar positioned at the top dead center that corresponds to the above-mentioned predetermined position, in order to avoid various inconveniences, such as the inconvenience that the lower end of the needle bar undesirably contacts an object to be sewn (fabric or cloth) during an operation for changing the cloth positioned on the machine table. Namely, it has been necessary that the stroke length over which the needle bar is driven to move up and down be set greater than a necessary minimum length. With such arrangements disclosed in the No. HEI-3-37960 publication, there would be encountered the inconvenience that noise and vibration tends to be great during the sewing operation due to the great stroke length of the needle bar. Further, because the needle bar stroke has a great fixed length, freedom with which to set the drive timing of the needle bar also tends to be limited. However, with diversification of embroidering operations today, there is also a demand that a space between the lower end of the needle bar in a rest (i.e., non-driven) state and the upper surface of the machine table be made as great as possible.

SUMMARY OF THE INVENTION

In view of the foregoing, it is an object of the present invention to provide a needle bar drive apparatus for a sewing machine which allows a great space to be secured between the lower end of the needle bar in the rest (i.e., non-driven) state and the upper surface of the machine table while keeping the stroke of the needle bar during a sewing operation to a necessary minimum length, and which also allows the drive timing of the needle bar to be changed freely and easily.

In order to accomplish the above-mentioned object, the present invention provides a needle bar drive apparatus for a sewing machine, which comprises: a dedicated drive source for driving a needle bar of the sewing machine to move up and down; and a control section for, when a sewing operation is to be performed, controlling the drive source to cause the needle bar to move up and down within a predetermined stroke range, but, when no sewing operation is to be performed, controlling the drive source to cause the needle bar to retreat to a predetermined evacuation position set above a top dead center within the predetermined stroke range.

The drive source is provided exclusively for driving the needle bar alone. When a sewing operation is to be performed, the needle bar is driven, by the drive source controlled by the control section, to move up and down (i.e., ascend and descend) within the predetermined stroke range, while, when no sewing operation is to be performed, the needle bar can be retreated to the predetermined evacuation position set above the top dead center within the predetermined stroke range. Thus, when no sewing operation is to be performed, a sufficiently great space can be secured between the lower end of the needle bar and the upper surface of a sewing machine table with the needle bar retreated to the evacuation position. In this way, the lower end of the needle bar can be reliably prevented from contacting an object to be sewn, such as a fabric or cloth, during, for example, replacement of the object to be sewn. Further, because the evacuation position is set above the sewing stroke range separately from the setting of the sewing stroke range, the predetermined stroke range of the needle bar during a sewing operation can be limited to a necessary minimum length for the sewing operation while securing a sufficiently great space between the lower end of the needle bar and the upper surface of the sewing machine table. Because the stroke range of the needle bar during a sewing operation can be minimized, noise and vibration during the sewing can be reduced effectively. Further, the timewise pattern of the upward and downward movement of the needle bar within the predetermined stroke range may be varied, so that the sewing condition can be adjusted. Because the stroke range of the needle bar during a sewing operation is minimized as mentioned above, the freedom in setting the drive timing of the needle bar can be increased, so that the sewing condition can be adjusted variously.

DETAILED DESCRIPTION OF THE INVENTION

Description will hereinafter be given about embodiments of the present invention, with reference to the accompanying drawings.

Figure 1:
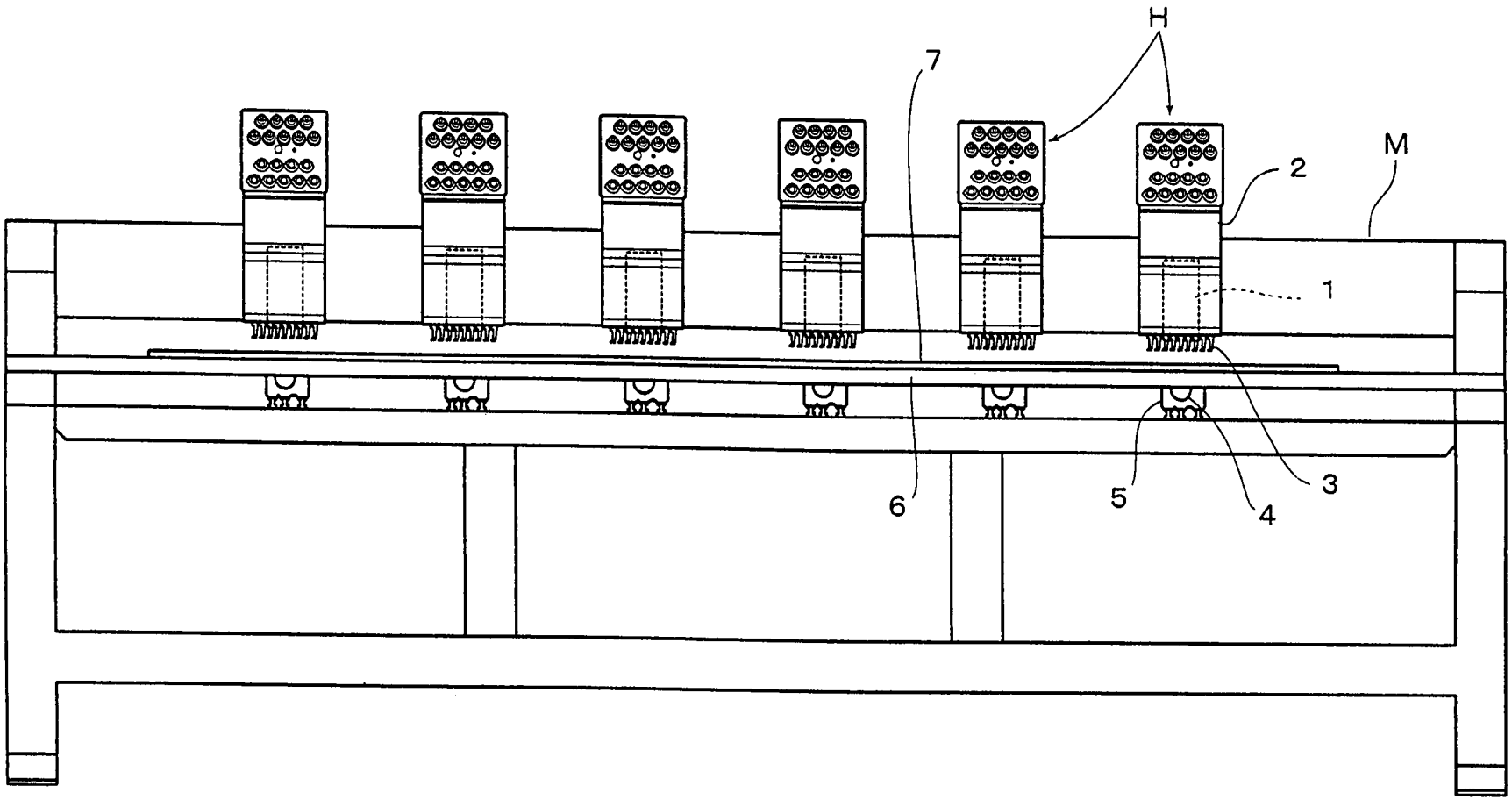
FIG. 1 is a front view of a multi-head sewing machine in accordance with an embodiment of the present invention.

FIG. 1 is a front view of a multi-head embroidery sewing machine in accordance with an embodiment of the present invention. Machine frame M, which forms a general framework of the multi-head embroidery sewing machine, has a plurality of (six in the illustrated example) sewing machine heads H mounted thereon. Each of the machine heads H includes an arm 1 fixed to the machine frame M, and a needle bar case 2 supported on the arm 1 in such a manner that the case 2 is slidable in a horizontal or left-right direction. In the needle bar case 2, there are provided a plurality of (nine in the illustrated example) needle bars 3 for vertical or up-and-down movement. Beneath each of the machine heads H, there are provided a rotary hook 4 and hook base 5 for supporting the rotary hook 4. Although not shown, the rotary hook 4 is driven to rotate by rotation of a main shaft of the sewing machine. On the main shaft, there is provided an encoder for detecting a rotational angle of the rotary hook 4. Table 6 is supported on the machine frame M, and an embroidery frame 7 for holding an embroidery workpiece (or object to be embroidered) in a stretched-out state is provided on the upper surface of the table 6. The embroidery frame 7 is driven, via a not-shown driving mechanism, to move in front-rear and left-right directions relative to the machine head H.

Figure 2:
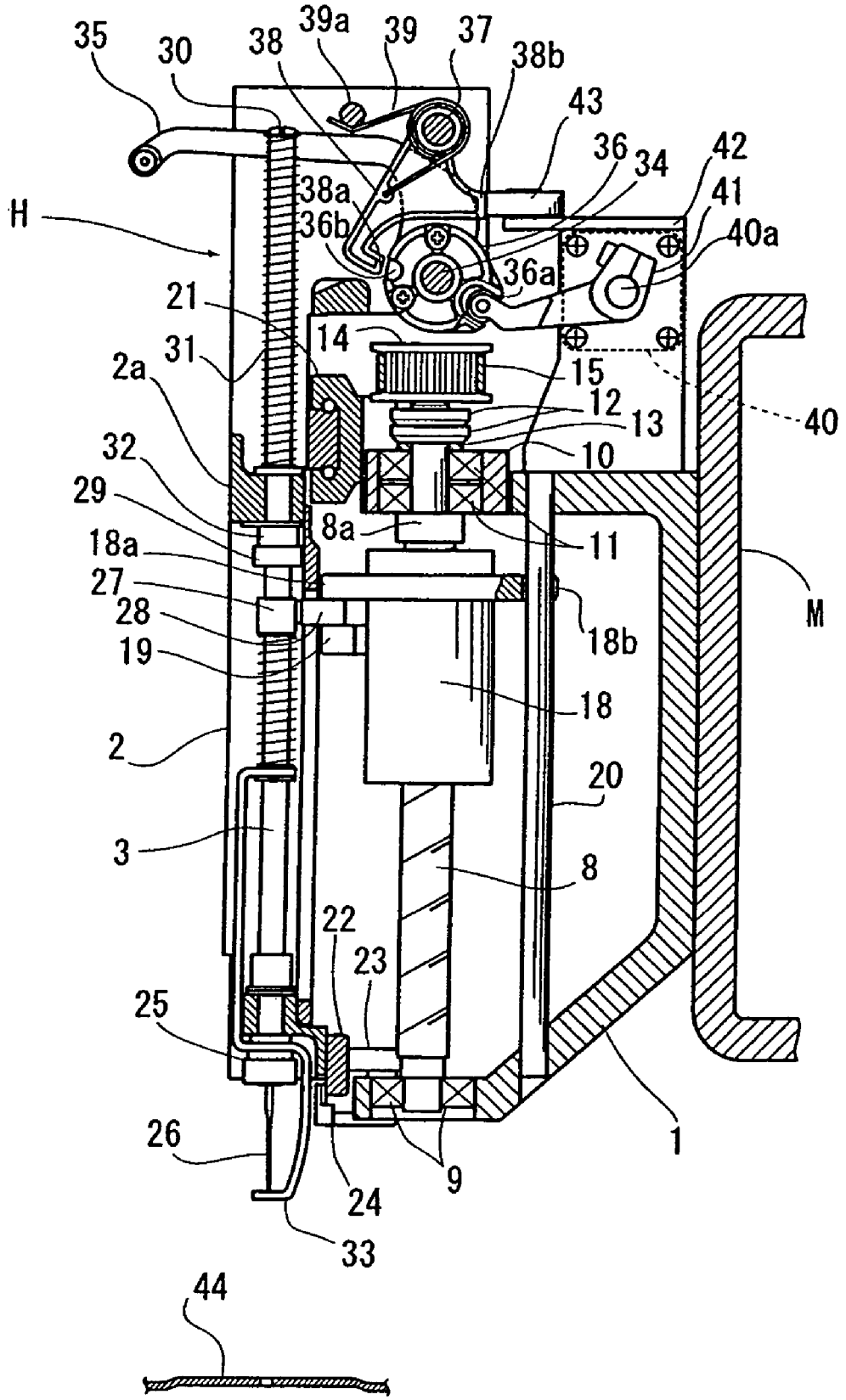
FIG. 2 is a sectional side view of a sewing machine head shown in FIG. 1.

FIG. 2 is a sectional side view of one of the machine heads H. The arm 1 is disposed to extend from the machine frame M toward the front side (left side in FIG. 2) of the sewing machine, and the needle bar case 2 is disposed to cover front and upper surfaces of the arm 1. Within the needle bar case 2, there are accommodated a power transmission mechanism for driving the needle bar 3 and various other mechanical components for performing an embroidering operation. As apparent from FIG. 2, the arm 1 has a front end portion formed into a sectional shape generally like a horseshoe (i.e., shape having generally parallel upper and lower end portions and a side wall portion integrally formed with the upper and lower end portions). Threaded rod 8, which functions as one of primary components of the mechanism for driving the needle bar 3, is rotatably supported on the arm 1. The threaded rod 8 has a thread formed on its peripheral surface spirally about the axis of the rod 8 and is positioned substantially vertically with respect to the upper and lower end portions of the arm 1. The threaded rod 8 is supported at its lower end by the lower end portion of the arm 1 via a bearing 9 and also supported at its upper portion by a bearing member 10, fixed to the upper end portion of the arm 1, via a bearing 11. The upper portion of the threaded rod 8 has a restriction section 8*a* of an enlarged diameter formed concentrically with the threaded rod 8, and this restriction section 8*a* is located under the bearing member 10. Further, two nut members 12 are screwed on the threaded rod 8 adjacent to the upper surface of the bearing member 10. Vertical position, relative to the arm 1, of the threaded rod 8 is adjustably fixed with the bearing member 10 (bearing 11) held between the restriction section 8*a* and the two nut members 12. Washer 13 is interposed between the nut members 12 and the upper surface of the bearing member 10.

Figure 3:
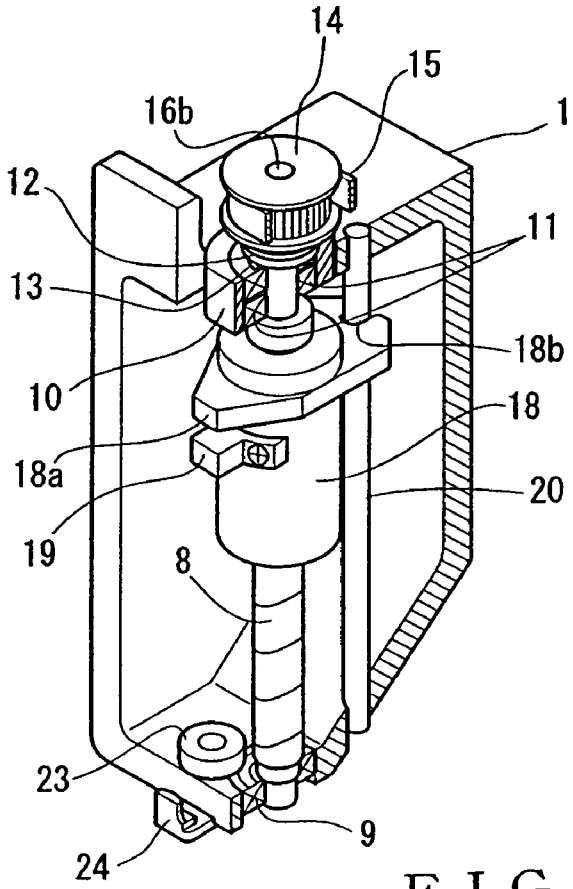
FIG. 3 is a partly-sectional perspective view extractively showing pertinent portions of a threaded rod and mechanisms peripheral thereto in the machine head of FIG. 2.
Figure 4:
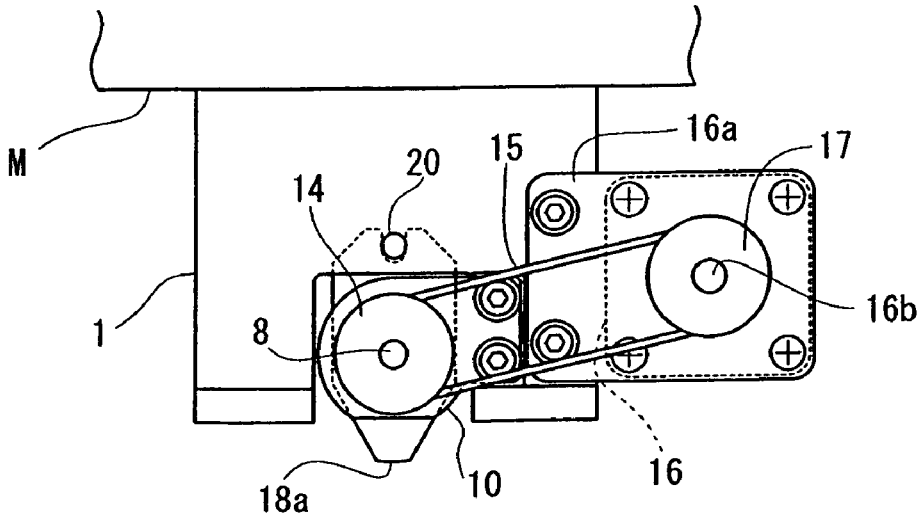
FIG. 4 is a plan view of the pertinent portions of the threaded rod and mechanisms of FIG. 3, which particularly shows a manner in which a drive motor is attached to an arm.
Figure 5:
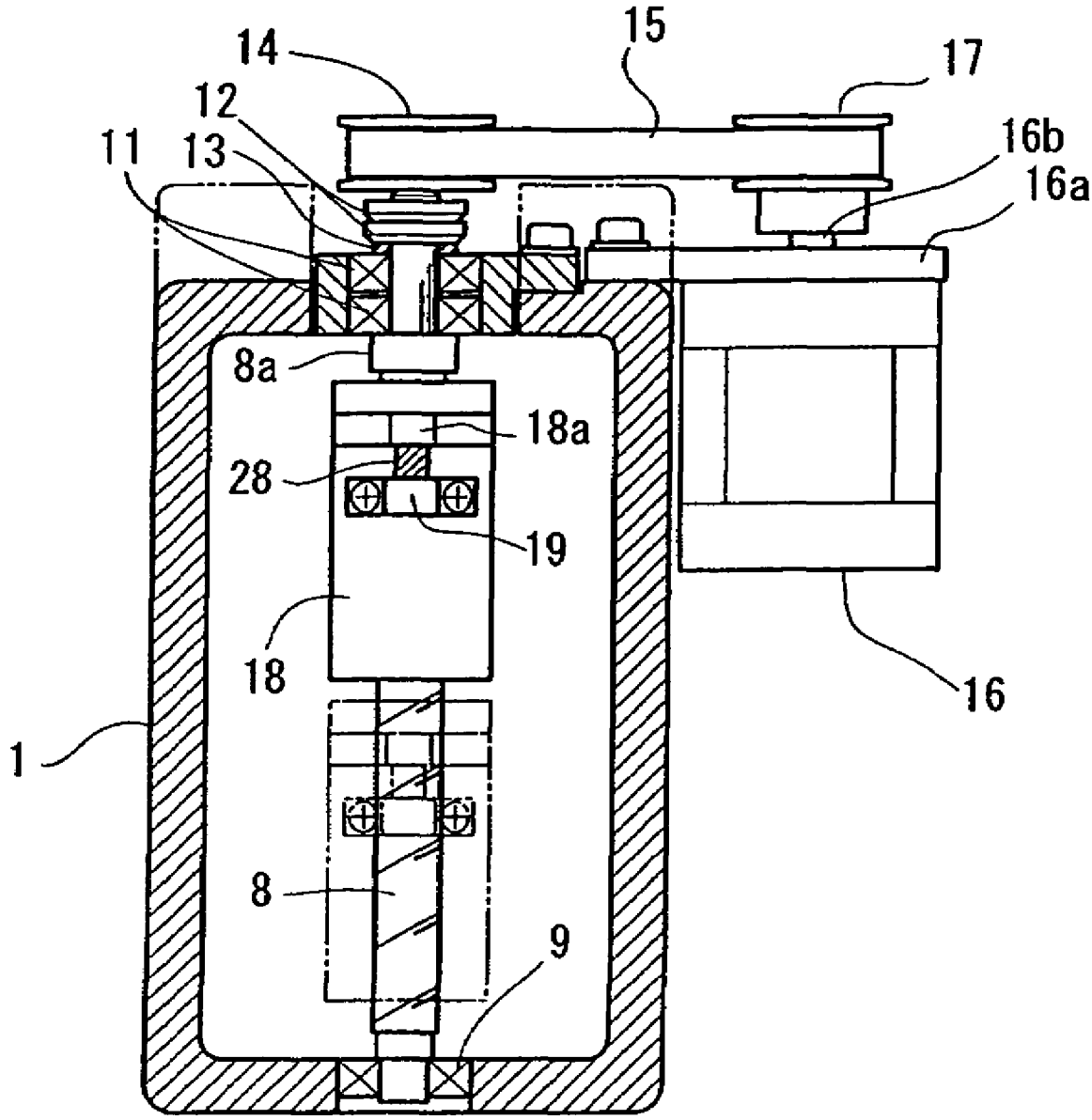
FIG. 5 is a sectional front view of the machine head shown in FIG. 4.

Pulley 14 is fixedly mounted on an upper end portion of the threaded rod 8 in concentric relation to the axis of the threaded rod 8, and the pulley 14 and the threaded rod 8 are rotatable together about the axis. As clear from FIG. 2, the pulley 14 and the nut members 12 disposed on an upper end portion of the threaded rod 8 project beyond the upper surface of the arm 1. FIG. 3 is a partly-sectional perspective view extractively showing pertinent portions of the threaded rod 8 and mechanisms peripheral thereto, where the needle bar case 2 and various mechanical elements attached to the needle bar case 2 are taken away for clarity of illustration. The pulley 14 is fixedly mounted on the upper end portion of the threaded rod 8 in concentric relation to the axis of the threaded rod 8, and the pulley 14 and the threaded rod 8 rotate together about the axis. Belt 15 is wound on the pulley 14, and this belt 15 is used to transmit a rotational drive force of a motor 16, provided exclusively for vertically driving the needle bar, to the pulley 14. FIG. 4 is a plan view showing the pertinent portions of FIG. 3 from above, which particularly shows a manner in which the above-mentioned motor 16 is mounted. Further, FIG. 5 is a partly-sectional front view showing the pertinent portions of FIG. 4 from the front of the sewing machine. As illustrated in FIGS. 4 and 5, the motor 16 is provided in correspondence with the threaded rod 8 (i.e., one motor 16 is provided per machine head H) and fixed to the arm 1 via a base member 16*a*. The drive motor 16 is disposed with its rotation shaft 16*b* extending in parallel relation to the axis of the threaded bar 8, and a drive pulley 17 is fixed to the upper end of the rotation shaft 16*b*. With the belt 15 wound on the pulley 14 and drive pulley 17, the pulley 14 is operatively connected, via the belt 15, with the drive pulley 17 for rotation therewith. Thus, upon activation of the drive motor 16, the rotation of the motor 16 is transmitted via the belt 15 to the pulley 14. Consequently, as the pulley 14 is rotated by being driven by the drive motor 16, the threaded rod 8 rotates about its axis.

Moving member 18, which is one of primary elements of the mechanism for driving the needle bar 3, is provided on the threaded rod 8 for vertical movement along the axial direction of the threaded rod 8. The moving member 18 as a whole has a substantially cylindrical shape, and it has an axial through-hole portion (not shown) formed, substantially centrally therethrough, to allow the threaded rod 8 to extend through the member 18 along the axis of the member 18. The through-hole portion of the moving member 18 is screwed on the threaded rod 8. Namely, a part or the whole of the inner peripheral surface of the through-hole portion in the moving member 18 is formed as a female thread meshingly engageable with a male thread formed on the outer peripheral surface of the threaded rod 8. With such arrangements, rotation of the threaded rod 8 is transmitted to the moving member 18. Further, a first engaging projection 18*a* projecting forward is provided at a predetermined front portion of the outer peripheral surface of the moving member 18, and an engaging recessed portion 18*b* extending rearward is provided at a predetermined rear portion of the outer peripheral surface. Second engaging projection 19 is fixed at a predetermined distance beneath the first engaging projection 18*a*. As will be later detailed, these first engaging projection 18*a* and second engaging projection 19 function as mechanical connection elements for interlocking the needle bar 3 to the vertical movement of the moving member 18. The engaging recessed portion 18*b* has a groove (notch) portion formed in a predetermined rear end portion thereof. Engaging rod 20 for engaging with the groove portion of the engaging recessed portion 18*b* is provided in the arm 1 in parallel with the threaded rod 8. With the engaging rod 20 fitted in the groove portion of the engaging recessed portion 18*b*, the moving member 18 is prevented from rotating about the axis (threaded rod 8).

As the threaded rod 8 is rotated about its axis through activation of the motor 16, the rotation force of the threaded rod 8 acts on the moving member 18. Because rotation of the moving member 18 is prevented by the fitting engagement between the engaging rod 20 and the engaging recessed portion 18*b*, the moving member 18 will never rotate with the rotation of the threaded rod 8. Therefore, as the threaded rod 8 rotates about its axis, the moving member 18 screwed on the threaded rod 8 moves vertically along the axis of the threaded rod 8 by being guided along the thread formed on the outer periphery of the threaded rod 8. Switching the rotation of the motor 16 between forward and reverse directions can reciprocate the moving member 18 in the vertical direction. In FIG. 5, the moving member 18 having moved downward is indicated by two-dot-dash lines.

On a front upper surface of the arm 1, there is provided a linear rail 21 for slidably supporting the needle bar case 2 in the left-right direction as viewed from the front of the sewing machine (i.e., perpendicularly relative to the surface of the sheet of FIG. 2). Guide rail 22, extending in parallel with the linear rail 21, is fixed to the rear surface of a lower end portion of the needle bar case 2, and a rotatable roller 23 and guide member 24 are provided adjacent to the arm 1. With the guide rail 22 held between the roller 23 and guide member 24, a lower end portion of the needle bar case 2 is guided during sliding movement of the needle bar case 2.

A plurality of (nine in the illustrated example) needle bars 3 are vertically movably supported in the needle bar case 2. Sewing needle 26 is provided at the lower end of each of the needle bar 3 via a needle clamp 25. Further, a needle bar clamp 27 is fixed to a substantial middle portion of each of the needle bars 3, and an engaging pin 28 is provided on and projects from the rear surface of each of the needle bar clamps 27. The engaging pin 28 engages with the first and second engaging projections 18*a* and 19 provided on the moving member 18, to function as an element for causing the needle bar 3 to move in interlocked relation to the vertical movement of the moving member 18. In FIG. 2, there is shown a state where the engaging pin 28 on a given one of the needle bars 3 (i.e., the one appearing in the figure) is in engagement with the first and second engaging projections 18*a* and 19. As illustrated, the engaging pin 28 is located between the first and second engaging projections 18*a* and 19 and vertically sandwiched between the two projections. Thus, the needle bar 3 is connected via the engaging pin 28 to the moving member 18, so that, as the moving member 18 moves up and down, the needle bar 3 is driven to reciprocate in the vertical direction in interlocked relation to the up-and-down movement of the moving member 18. FIG. 5 is a sectional view of the engaging pin 28 located between the first and second engaging projections 18*a* and 19. Interval between the first and second engaging projections 18*a* and 19 is approximately equal to the vertical width of the engaging pin 28, and it is only necessary that an interval be secured to allow the engaging pin 28 to horizontally move into and from between the first and second engaging projections 18*a* and 19. It is preferable to minimize vertical shaky movement of the engaging pin 28 when the engaging pin 28 is located between the first and second engaging projections 18*a* and 19.

Selection of a needle bar 3 to be connected to (i.e., to be driven by) the moving member 18 is made via a not-shown color change mechanism. Namely, as the needle bar case 2 is moved in the left-right direction via the color change mechanism, the needle bar 3 to be connected to the moving member 18, i.e. the engaging pin 28 located between the first and second engaging projections 18*a* and 19, can be switched to another needle bar 3, or engaging pin 28, in accordance with a sliding position of the needle bar case 2. Namely, any desired needle bar 3 to be driven can be selected from among the plurality of (e.g., nine) needle bars 3. Here, all of the non-selected needle bars 3 are retained in a predetermined standby or evacuation position until selected by the color change mechanism.

Top dead center stopper 29 is fixed at a position immediately above the needle bar clamp 27 of each of the needle bars 3, and a cushion 32 is provided on the upper surface of the top dead center stopper 29. Further, a spring support 30 is provided at the upper end of each of the needle bars 3, and a needle bar retaining spring 31 for normally urging the needle bar 3 in the upward direction is provided between the spring support 30 and the upper surface of a horizontal frame 2*a* of the needle bar case 2 in substantial concentric relation to the needle bar 3. Each of the needle bars 3 not selected via the color change mechanism is normally urged upward by the resilient force of the needle bar retaining spring 31, and, as shown in FIG. 2, the top dead center stopper 29 is held at a predetermined position in abutment against the lower surface of the horizontal frame 2*a* (i.e., top dead center point of the needle bar 3 during a non-selected time period) via the cushion 32. Such a predetermined position where the non-selected needle bar 3 is retained (top dead center during the non-selected time period) will be referred in this specification to as "evacuation position". The evacuation position is set upwardly of the vertical movement stroke range of the needle bar 3.

At and near the lower end of each of the needle bars 3, there are provided the above-mentioned sewing needle 26 and a cloth presser 33. These sewing needle 26 and cloth presser 33 vertically reciprocate in interlocked relation to the vertical or up-and-down movement of the corresponding needle bar 3. Further, reference numeral 44 of FIG. 2 represents a conventional needle plate fixed to the upper surface of the hook base 5. The cloth presser 33, which is constructed to move vertically in interlocked relation to the vertical movement of the corresponding needle bar 3, presses an embroidery workpiece against the upper surface of the needle plate 44 when the needle 3 has descended (i.e., as the sewing needle 26 passes through the embroidery workpiece).

In an upper portion of the needle bar case 2, a weight support shaft 34 extends between left and right side surfaces of the needle bar case 2 in the sliding direction of the case 2. A plurality of (nine in the illustrated example) weights 35, corresponding to the plurality of needle bars 3, are pivotably mounted on the weight support shaft 34. Each of the weights 35 is mounted so that its distal end portion projects through a wall of the needle bar case 2 to a front side area (left side area in FIG. 2) of the sewing machine, as seen in FIG. 2. Each of the weights 35 is fixed at its boss section 36, formed at proximal end portion (rear end portion), on the weight support shaft 34. The boss section 36 has a fitting groove 36*a* formed in a predetermined rear peripheral surface portion thereof, and a distal end portion of a later-described drive lever 41 is fittable in the fitting groove 36*a*. Further, the boss section 36 has an engaging recessed portion 36*b* formed in a predetermined front peripheral surface portion thereof, and a locking claw 38*a* of a later-described lock lever 38 is engageable in the engaging recessed portion 36*b*.

Further, in an upper portion, above the weight support shaft 34, of the needle bar case 2, a support shaft 37 is supported in parallel with the weight support shaft 34, and nine lock levers 38, corresponding to the weights 35, are pivotably mounted on the support shaft 37. The lock lever 38 has the locking claw 38*a* provided on its free end portion. Further, each of the lock lever 38 has a torsion spring 39 secured to a proximal end portion thereof, and the torsion spring 39 is fitted in a fitting groove formed in the outer peripheral surface of the support shaft 37. The torsion spring 39 has one end engaged by the body of the lock lever 38 and the other end hooked on a bar 39*a* provided in parallel with the support shaft 37. With the torsion spring 39 normally urging the lock lever 38 in a counterclockwise direction of FIG. 2, a locking claw 38*b* of each of the lock lever 38 is fittable in the engaging recessed portion 36*b* of the boss section 36. In a normal state (i.e., when the corresponding needle bar 3 is not being selected), the locking claw 38*a* of the lock lever 38 fits in the engaging recessed portion 36*b* of the boss section 36 to thereby keep the weight 35 at a predetermined posture (at the top dead center position) against pivotal movement.

In a predetermined position above the arm 1, there is provided a drive motor 40 (indicated by dotted lines in FIG. 2) for driving the weights 35. Drive lever 41 is connected to a motor shaft 40*a* of the motor 40 so that it can pivot in response to driving by the drive motor 40. When the corresponding needle bar 3 has been selected via the color change mechanism, the boss section 36 of the weight 35 is positioned in front of the drive lever 41 so that a distal end portion of the drive lever 41 fits in the fitting groove 36*a* of the boss section 36 corresponding to the selected needle bar 3. In this way, the drive force of the drive lever 41 can be transmitted to the weight 35 in question. In this state, locking, by the lock lever 38, of the weight 35 has been canceled as illustrated in FIG. 2, so that the weight 35 in question pivots vertically in response to a pivoting drive force given from the drive lever 41. Lock canceling mechanism to be used for this purpose has already been described above.

Roller 43 is rotatably supported at a predetermined position of a front end portion of a base 42 to which the drive motor 40 is fixed. The roller 43 is movable into abutting engagement with the projection 38*b* provided at the rear end of the lock lever 38 corresponding to the needle bar 3 selected by the color change mechanism. The lock lever 38 corresponding to the selected needle bar 3 is pushed forward by the roller 43 being abutted against the projection 38*b*, so that it is rotationally displaced in the clockwise direction about the support shaft 37 against the biasing force of the torsion spring 39. Due to the clockwise rotational displacement of the lock lever 38, the locking claw 38*a* of the lock lever 38 disengages from the engaging recessed portion 36*b* of the boss section 36 as seen in FIG. 2. In this way, the weight 35 selected by the color change mechanism is released from the locked state (i.e., from the state where it is held in a predetermined posture). Thus, once the drive motor 40 is activated, the weight 35 corresponding to the selected needle bar 3 is caused to pivot.

Figure 6:
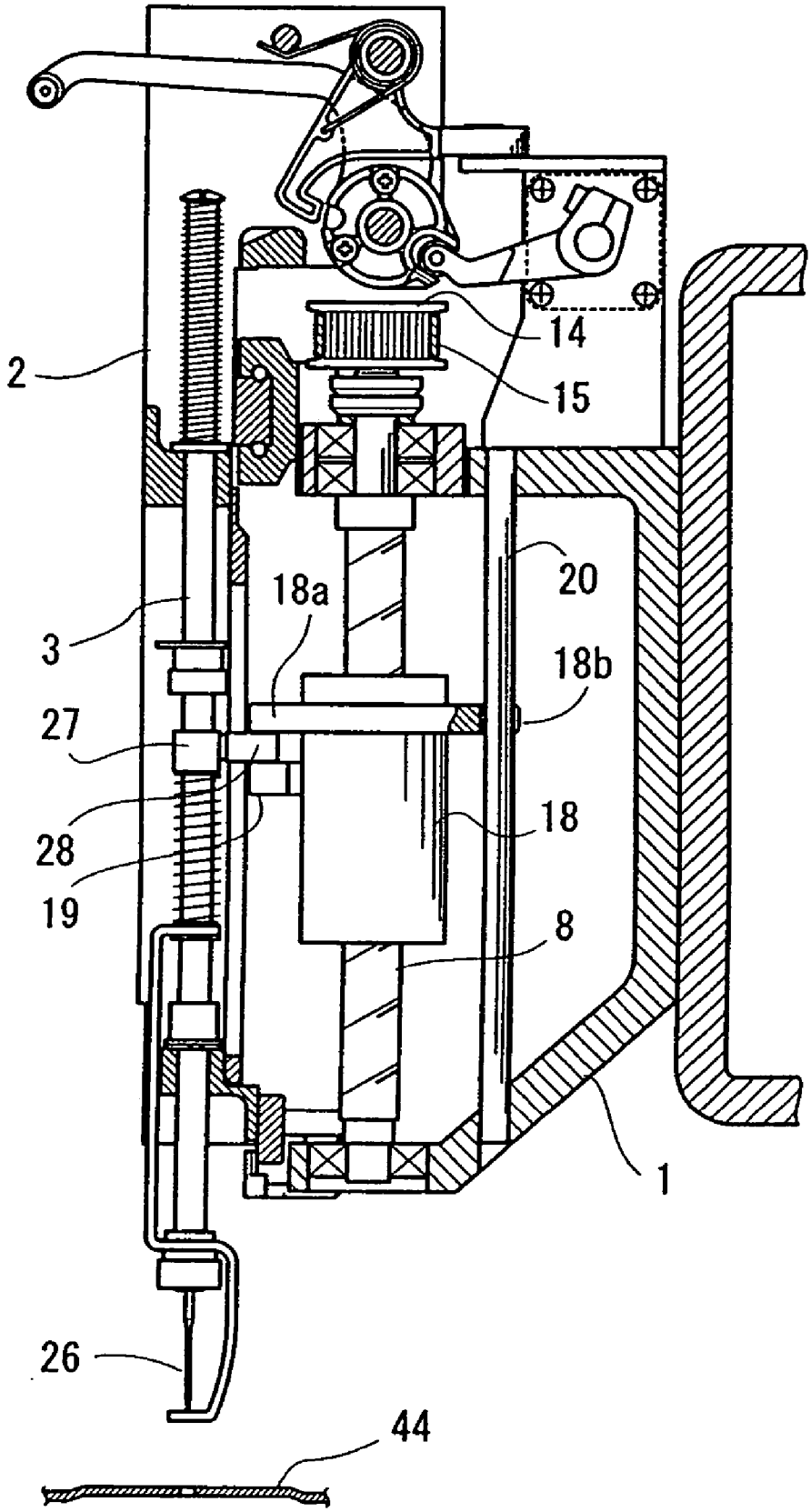
FIG. 6 is a sectional side view of the machine head in the embodiment, which particularly shows the needle bar positioned at a top dead center in a sewing stroke.
Figure 7:
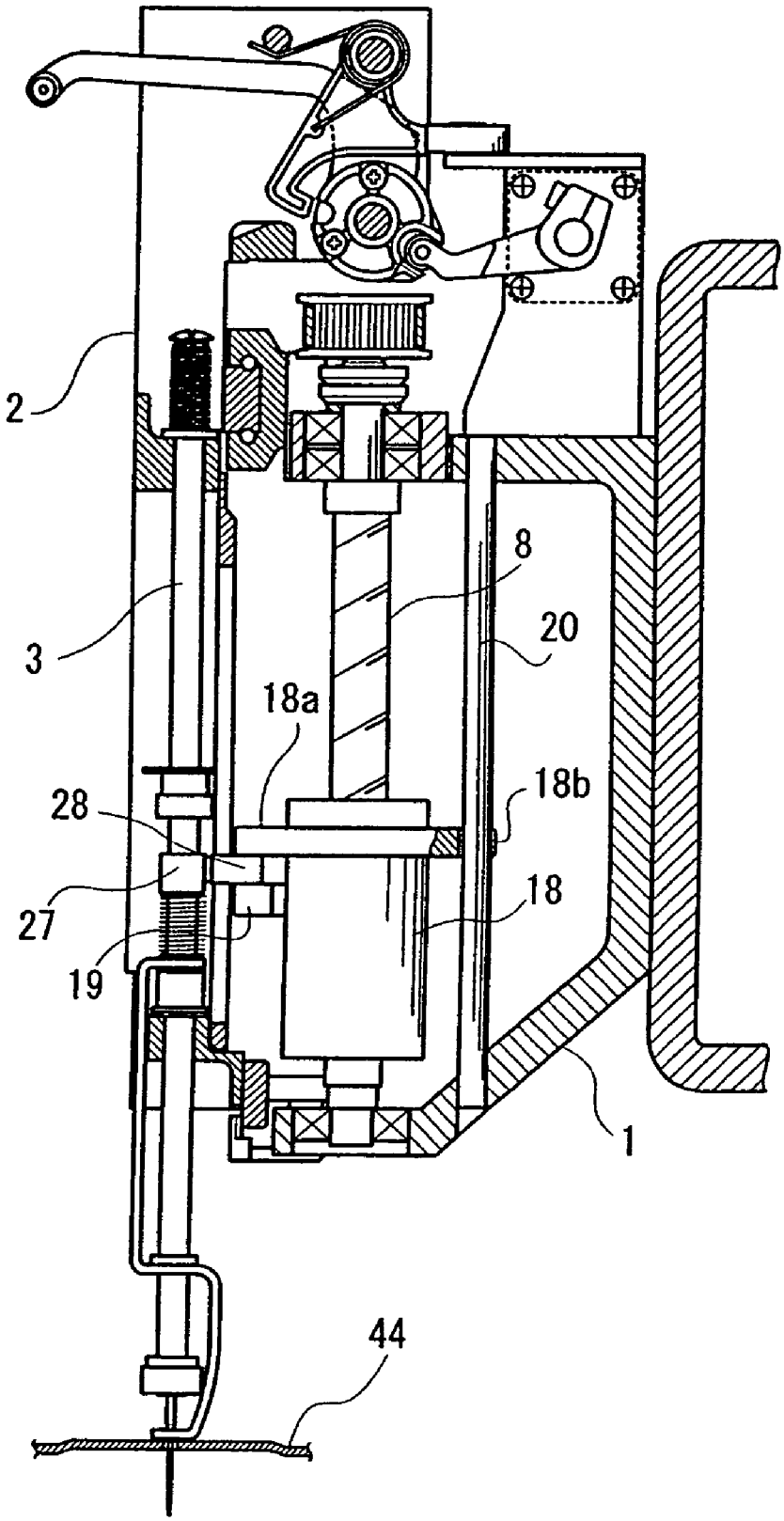
FIG. 7 is a sectional side view of the machine head in the embodiment, which particularly shows the needle bar positioned at a bottom dead center in the sewing stroke.
Figure 8:
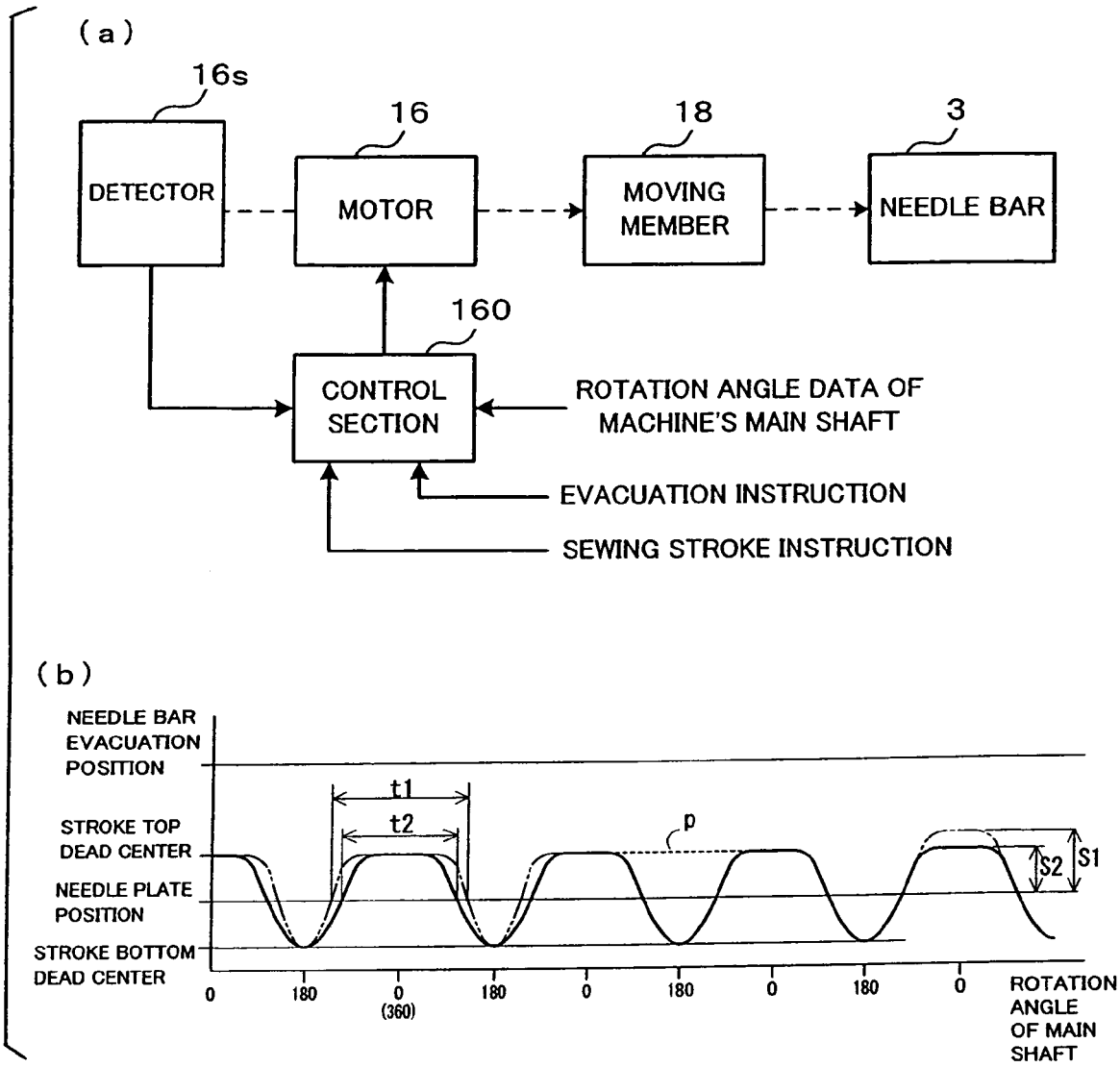
FIG. 8(*a*) is a control system diagram of the needle bar drive motor, and FIG. 8(*b*) is a chart showing operation timing of the needle bar in the embodiment.

Next, how the needle bar 3 is driven in the instant embodiment is described, with reference to sectional side views of the machine head H shown in FIGS. 6 and 7 and a control system diagram shown in FIG. 8(*a*). As noted above, FIG. 2 shows the needle bar 3 held in the predetermined evacuation position set above the top dead center in the sewing drive stroke (top dead center in the sewing stroke) during a sewing operation. At that time, in order to evacuate the needle bar 3, the drive motor 16 is controlled so that the moving member 18 is positioned at the top dead center in the movement range of the moving member 18 (i.e., top dead center of the needle bar 8), which corresponds to the evacuation position of the needle bar 3. Namely, in order to control the rotation of the drive motor 16, there are provided a detector 16*s* for detecting a rotational position, rotational amount or number of rotations of the motor 16, and a control section 160, as seen in FIG. 8(*a*). Once an evacuation instruction is given, the control section 160 controls the motor 16 to rotate in the direction to cause the moving member 18 to move upwardly and then, on the basis of a detection output from the detector 16*s*, controls the motor 16 to stop rotating when the moving member 18 has reached the uppermost dead center point corresponding to the needle bar evacuation position. Namely, after the motor 16 has rotated, in the direction to move the moving member 18 upwardly by a predetermined amount, to the uppermost dead center point corresponding to the needle bar evacuation position, the motor 16 stops rotating at that position. In this way, the needle bar 3 currently selected by the color change mechanism is also positioned in the evacuation position similarly to the other or non-selected needle bars 3. When all of the needle bars 3, including the currently-selected needle bar 3, are in the evacuation position, the height position of the engaging pin 28 of each of the needle bar 3 and the height position between the first engaging projection 18*a* of the moving member 18 and the second engaging projection 19 agree with each other, and thus, any desired one of the needle bars 3 can be selected by the needle bar case 2 being slid via the color change mechanism. For example, when the object to be sewn is to be replaced, control is performed to position all of the needle bars 3 in the evacuation position. Such control can provide a great gap between the lower end of each of the needle bars 3 and the upper surface of the table 6, to thereby facilitate the replacement of the object to be sewn.

FIG. 6 shows the selected needle bar 3 positioned at the top dead center in the vertical sewing stroke (i.e., stroke top dead center). After a desired one of the needle bars 3 has been selected in the evacuation position, and immediately before a start of embroidering operation, the drive motor 16 is activated to rotate the threaded rod 8 by a predetermined amount, to thereby move the moving member 18 downwardly to a predetermined stroke top dead center position as illustrated in FIG. 6. Consequently, the selected needle bar 3 descends to the top dead center of the vertical stroke in interlocked relation to the downward movement of the moving member 18. Namely, in FIG. 8(*a*), the control section 160 controls the motor 16 to rotate in the direction to move the moving member 18 downwardly and then temporarily stop rotating once the moving member 18 arrives at the predetermined stroke top dead center position. Note that the top dead center position in the vertical sewing stroke range of the needle bar 3 (i.e., stroke top dead center position) may be varied as desired, for example, in accordance with the thickness of the embroidery workpiece. For example, the top dead center position in the sewing stroke range may be varied as desired by the user, and that the moving member 18 has reached the thus-set stroke top dead center may be determined through a comparison between the detection output from the detector 16*s* and the setting of the stroke top dead center position.

FIG. 7 shows the selected needle bar 3 positioned at the bottom dead center of the vertical stroke (bottom dead center position). Once a sewing stroke instruction is given in response to embroider starting operation, the control section 160 controls the drive motor 16 to rotate in the forward direction to thereby rotate the threaded rod 8 by a predetermined amount in the forward direction, so that the moving member 18 and needle bar 3 are caused to descend to the bottom dead center shown in FIG. 7. With the needle bar 3 at the bottom dead of FIG. 7, the cloth presser 33 is engaged by the needle plate 44, and the sewing needle 26 is inserted through a hole formed in the needle plate 44 to pass through an embroidery workpiece (not shown). Once the moving member 18 and needle bar 3 descend to the bottom dead center, the control section 160 determines, on the basis of the detection output of the detector 16*s*, that the moving member 18 has reached the predetermined stroke bottom dead center, and then it causes the drive motor 16 to temporarily stop rotating. Then, the control section 160 controls the motor 16 to rotate in the reverse direction to thereby rotate the threaded rod 8 by a predetermined amount in the reverse direction, so that the moving member 18 and needle bar 3 are caused to ascend to the top dead center shown in FIG. 6. Once the moving member 18 and needle bar 3 ascend to the top dead center, the control section 160 determines, on the basis of the detection output of the detector 16*s*, that the moving member 18 has reached the predetermined stroke top dead center, and then it causes the drive motor 16 to temporarily stop rotating. If the sewing stroke instruction is still being given, the drive motor 16 is again controlled to rotate in the forward direction, so as to cause the moving member 18 and needle bar 3 to descend to the bottom dead center of FIG. 7. By the drive motor 16 being driven in the both of the forward and reverse directions by the predetermined amount at a time, the moving member 18 and needle bar 3 ascend and descend (i.e., move up and down) within a predetermined vertical stroke range (i.e., between the top dead center of FIG. 6 and the bottom dead center of FIG. 7). In this way, the sewing needle 26 is driven in the vertical direction so that it can perform embroidering. Namely, in the embroidering operation, the needle bar 3 is driven to ascend and descend between the top dead center of FIG. 6 and the bottom dead center of FIG. 7. In order to effect switching of the needle bar 3 by the color change mechanism or replacement of the embroidery workpiece after completion of the embroidering operation, the moving member 18 and needle bar 3 can be moved upward to the evacuation position as illustrated in FIG. 2. In the instant embodiment, where the needle bar 3 can be retracted to the evacuation position as necessary in the above-mentioned manner, it is possible to set the ascending/descending stroke range of the needle bar 3 without considering the necessity of providing a great interval between the lower end of the needle bar 3 and the upper surface of the machine table 6 for conveniences of replacement of the embroidery workpiece etc., and thus, the ascending/descending stroke range can be set to a necessary minimum length for sewing.

Whereas the instant embodiment has been described, for convenience, in relation to the case where the rotation direction to cause the moving member 18 and needle bar 3 to descend is referred to as the forward direction while the rotation direction to cause the moving member 18 and needle bar 3 to ascend is referred to as the reverse direction, any desired one of the rotation directions may be referred to as the forward or reverse direction.

Further, the detector 16*s* is not limited to the type which directly detects the rotational position or amount or the number of rotations of the motor 16, and it may be of any desired types, such as a type which detects, in a non-contact or contact fashion, that the moving member 18 or needle bar 3 has actually reached the above-mentioned evacuation position, stroke top dead center and stroke bottom dead center.

Further, the control section 160 may be implemented by a dedicated hardware device, or by a combination of a general-purpose control device, such as a CPU or microcomputer, and a software program arranged to perform the above-described control.

FIG. 8(*b*) is a chart showing operation timing of the needle bar 3, where the horizontal axis represents the rotational angle of the machine's main shaft (rotary hook 4) while the vertical shaft represents the stroke position of the needle bar 3. As known in the art, activation control timing of the drive motor 16 is controlled in accordance with the rotational angle of the machine's main shaft (rotary hook 4). Namely, activation of the drive motor 16 per sewing stroke is performed in synchronism with rotating movement of the rotary hook 4 on the basis of the output signal of the encoder detecting the rotational angle of the rotary hook 4 (rotation angle data of the machine's main shaft or rotary hook 4). In FIG. 8(*b*), a solid line indicates fundamental operation timing of the sewing needle 3 (timewise pattern of ascending and descending movement of the sewing needle 3). As clear from the figure, relationship between the fundamental operation timing and the rotational angle of the rotary hook 4 is set such that the activation control of the drive motor 16 is performed to cause the sewing needle 3 to be at the bottom dead pint position (see FIG. 7) when the rotational angle of the main shaft is 180°, when the rotational angle of the main shaft has reached 180°, the rotation direction of the drive motor 16 is inverted to cause the needle bar 3 to ascend to the top dead center position (see FIG. 6). Assuming that the entire movable range of the needle bar 3 (and moving member 18) is from the stroke bottom dead center position to the needle bar evacuation position, it can be seen from FIG. 8(*b*) that the stroke range (between the stroke top dead center position and the stroke bottom point position) of the needle bar 3 during a sewing operation is limited to only a necessary minimum position of the entire movable range.

The timewise pattern of the ascending and descending movement of the needle bar 3 can be changed, for example, by controlling the activation of the drive motor 16 in such a manner that, as indicated by a two-dot-dash line in FIG. 8(*b*), the descending timing of the needle bar 3 is retarded from the solid-line fundamental operation timing relative to the main shaft's rotation angle while the ascending timing of the needle bar 3 is advanced relative to the main shaft's rotation angle. In this way, it is possible to appropriately respond to changes in the "sewing condition", e.g. for effecting slow embroidery sewing and for tight embroidery sewing. According to the operation timing of the needle bar 3 indicated by the two-dot-dash line in FIG. 8(*b*), a time period t1 during which the needle bar 3, i.e. sewing needle 26, is located above the needle plate 44 (indicated as "needle plate position" in FIG. 8(*b*)) can be made longer than a corresponding time period t2 based on the fundamental timing indicated by the solid line. The embroidery frame 7 is driven in the front-rear and left-right directions (see FIG. 1) when the sewing needle 26 is located above the needle plate 44; when the sewing needle 26 is located below the needle plate 44, the sewing needle 26 is piercing through the fabric to be embroidered (i.e., embroidery workpiece). Thus, with the longer time period t1, the time period over which the embroidery frame 7 can be driven longer, so that the amount of movement of the embroidery frame 7 can be maximized.

Further, by performing control to temporarily stop the activation of the drive motor 16 and temporarily stop the rotation of the threaded rod 8, driving of the needle bar 3 can be temporarily stopped by one strike to permit one stitch skip (jump) as indicated by a dotted line in FIG. 8(*b*), during which time the embroidery frame can be moved a longer distance. Further, with the driving amount of the motor 16 variably controlled, the top dead center of the needle 3 can be freely set/changed in accordance with the sewing condition, such as the thickness of the embroidery workpiece; for example, the top dead center of the ascending/descending stroke can be moved further upward as indicated by a one-dot-dash line (in FIG. 8(*b*), increased upward movement is indicated by S1, and the normal top dead center is indicated by S2).

The above-described instant embodiment, arranged to drive the needle bar 3 via the threaded rod 8 and moving member 18 screwed on the threaded rod 8, can dispense with complicated power transmission mechanisms, such as cam mechanisms, that has heretofore been necessary to drive the needle bar 8, so that the construction of the needle bar driving mechanisms can be simplified. Further because the above-described instant embodiment allows the needle 3 to be driven to move up and down with the necessary minimum stroke as shown in FIGS. 6 and 7 and allows the needle bar 3 to retreat to the evacuation position during a non-selected period, at the time of replacement of the cloth to be embroidered to another cloth, or the like, it can not only reduce noise and vibration but also enhance the freedom in setting and changing the ascending/descending timing. Further, because the needle bar 3 is positioned at the evacuation position higher than the embroidering stroke, the instant embodiment can secure a great space between the lower end of the sewing needle and the upper surface of the machine table.

In the instant embodiment, as described above, the moving member 18 reciprocates vertically relatively by the threaded rod 8 being rotated by the drive motor 16. However, the present invention is not so limited, and the moving member 18 may be constructed as a female screw rotated by the drive motor 18 so that the threaded rod 8 ascends and descends relative to the moving member (female screw) 18 rotated by the motor 16 and thus the needle bar 3 reciprocates in interlocked relation to the vertical movement of the threaded rod 8. Further, whereas the instant embodiment has been described above in relation to the case where the drive motor 16 for rotating the threaded rod 8 is provided for each of the machine head H, i.e. one drive motor 16 per head H, the present invention is not so limited, and the threaded rods 8 of all of the machine heads may be driven by one and the same drive source. Further, there may be provided a jump device to break the driving relationship between the moving member 18 and the needle bar 3.

Figure 9:
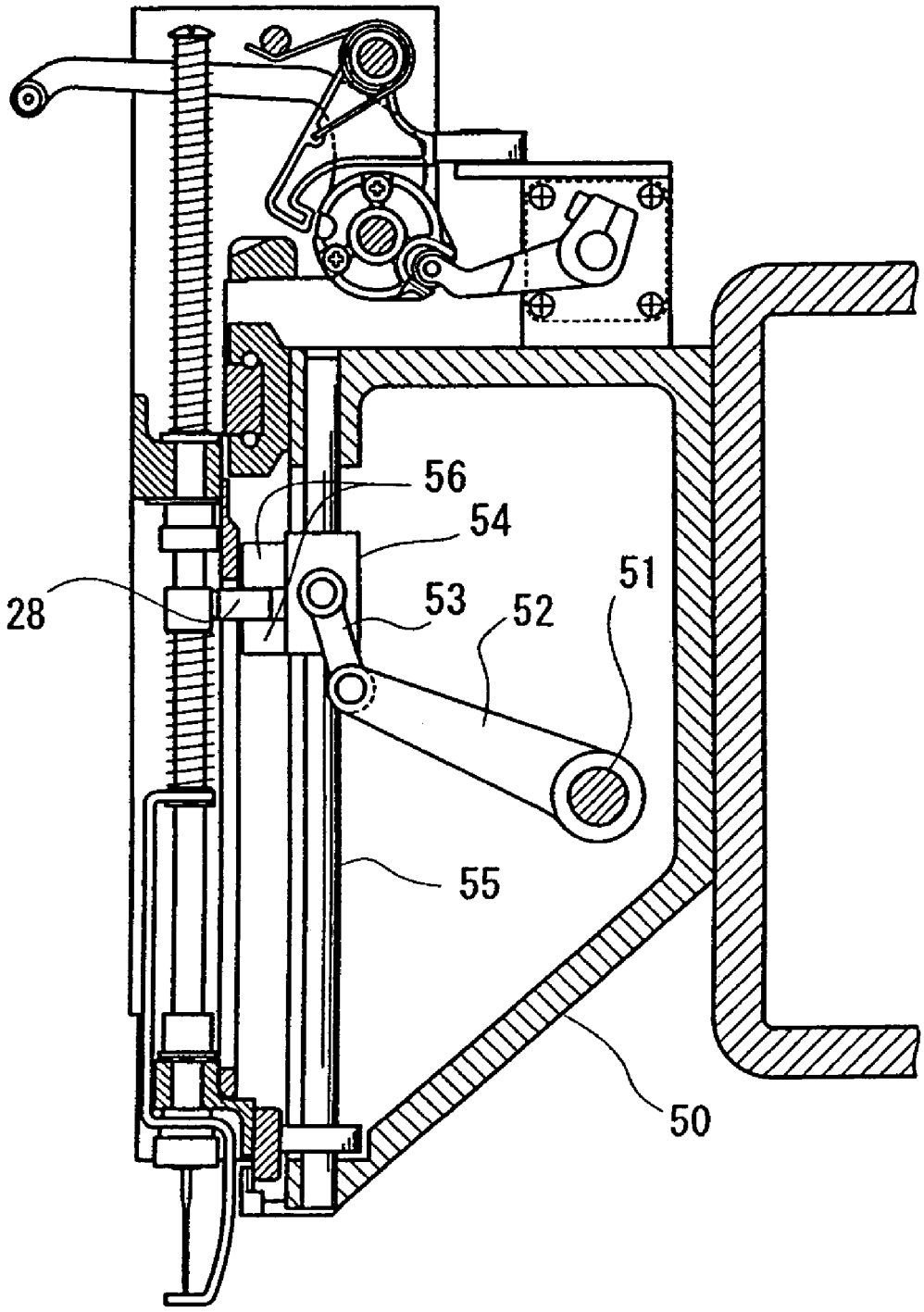
FIG. 9 is a sectional side view of the machine head, which shows another example construction of a needle bar driving mechanism.

Further, the instant embodiment has been described above in relation to the case where the needle bar driving mechanism is constructed of the threaded rod 8 and moving member 18 screwed on the threaded rod 8 and the moving member 18 is caused to ascend or descend through a screw action by the threaded rod 18 being rotated by the motor 16. However, the needle bar driving mechanism in the present invention is not so limited. FIG. 9 is a view showing another example construction of the needle bar driving mechanism of the present invention. In FIG. 9, a drive shaft 51 of the drive motor fixed to an arm 50 rotates about an axis extending perpendicularly to a side surface of the arm 50. Drive lever 52 is connected at its rear end to the drive shaft 51 for vertical pivotal movement relative to the drive shaft 51. Connecting lever 53 is pivotably connected at one end to a distal end portion of the drive lever 52, and a moving member 54 is pivotably connected to the other end portion of the connecting lever 53. The moving member 54 is vertically movably mounted on a support bar 55 provided vertically along a front surface (left surface in the figure) of the arm 50, and it is connected to the drive lever 52 via the connecting lever 53. On a front surface of the moving member 54, there are formed a pair of upper and lower projections 56, and the engaging pin 28 of the currently selected needle bar is held between the upper and lower projections 56. By the motor being driven in both of the forward and reverse directions, the drive lever 52 is driven to pivot vertically about the drive shaft 51. Because the moving member 54 is connected to the drive lever 52 via the connecting lever 53, the moving member 54 reciprocates vertically along the axis of the support bar 55 in response to the pivoting movement of the drive lever 52, in response to which the currently selected bar 3 is driven to ascend and descend.

Figure 10:
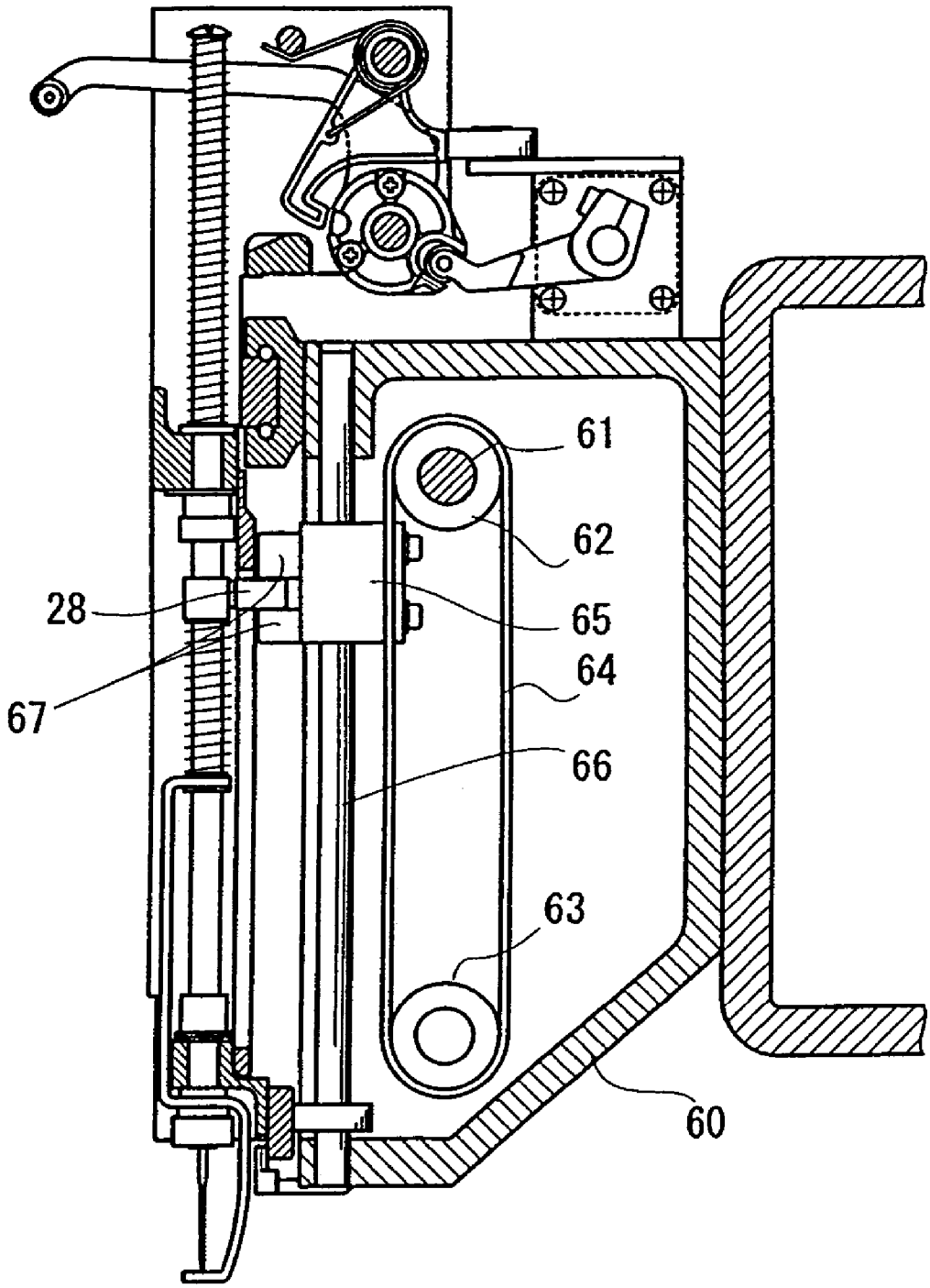
FIG. 10 is a sectional side view of the machine head, which shows still another example construction of the needle bar driving mechanism.

FIG. 10 is a view showing another example construction of the needle bar driving mechanism of the present invention. In FIG. 10, a rotation shaft 61 of the drive motor, provided on an upper portion of a side surface of an arm 60 is rotatable about an axis extending perpendicularly to the side surface, and a driving pulley 62 is mounted on the rotation shaft 61. Further, a driven pulley 63 is pivotably supported on the side surface of the arm 60 and vertically spaced from the driving pulley 62. Transmission belt 64 is wound on the driving pulley 62 and driven pulley 63 to extend vertically between the pulleys 62 and 63 along the arm 60. Moving member 65 is fixed to a front surface (left surface in the figure) of the arm 60. The moving member 65 is vertically movably mounted on a support bar 66 extending vertically along the front surface of the arm 60. On a front surface of the moving member 65, there are formed a pair of engaging projections 67 between which is held the engaging pin 28. By the motor being driven in both of the forward and reverse directions, the moving member 54 fixed to the belt 64 can be caused to reciprocate along the axis of the support bar 66. Thus, with such arrangements too, the selected needle bar 3 moves up and down in interlocked relation to the vertical movement of the moving member 65.

In each of FIGS. 9 and 10, the needle bar 3 of the needle bar driving mechanism is shown as evacuated in the evacuation position. With the needle bar driving mechanisms of FIGS. 9 and 10 too, appropriately controlling the operation of the drive motor allows the needle bar 3 to ascend and descend with a necessary minimum stroke during embroidering, allows the needle bar drive timing to be freely set or changed, and allows the needle bar 3 to retreat to the evacuation position at the time of replacement of the cloth to be embroidered. Note that the drive motor for use in the present invention provided exclusively for driving the needle bar may be a linear motor instead of being limited to the rotary motor.

The invention claimed is:

1. A needle bar drive apparatus for a sewing machine comprising:

a dedicated drive source for driving a needle bar of the sewing machine-to-move up and down; and control means for, when the needle bar is driven for performing a sewing operation, controlling said drive source to cause the needle bar to move up and down within a predetermined stroke range, and, when no sewing operation is to be performed, controlling said drive source to cause the needle bar to retreat to a predetermined evacuation position set above a top dead center of the predetermined stroke range.

2. A needle bar drive apparatus as claimed in claim 1, wherein said control means controls the drive source to vary a timewise pattern of upward and downward movement of the needle bar within the predetermined stroke range.

3. A needle bar drive apparatus as claimed in claim 1, wherein the stroke range is variable, in accordance with a thickness of an object for sewing, by variably setting a position of the top dead center of the predetermined stroke range.

4. A needle bar drive apparatus as claimed in claim 1, wherein said drive source comprises a rotary motor for driving the needle bar up and down—and a movement conversion mechanism for converting rotary movement of said drive source into linear reciprocating movement.

5. A needle bar drive apparatus as claimed in claim 1, wherein the sewing machine includes a plurality of sewing heads, and said drive source is provided for each of the sewing heads.

* * * * *